US010443973B2

(12) United States Patent
Bofill

(10) Patent No.: US 10,443,973 B2
(45) Date of Patent: Oct. 15, 2019

(54) WEAPON FOREGRIP

(71) Applicant: Masters Outdoors, LLC, Opa Locka, FL (US)

(72) Inventor: Peter Bofill, Opa Locka, FL (US)

( * ) Notice: Subject to any disclaimer, the term of this patent is extended or adjusted under 35 U.S.C. 154(b) by 0 days.

(21) Appl. No.: 16/020,785

(22) Filed: Jun. 27, 2018

(65) Prior Publication Data

US 2019/0257614 A1 Aug. 22, 2019

Related U.S. Application Data

(63) Continuation-in-part of application No. 14/924,508, filed on Oct. 27, 2015, now Pat. No. 10,209,028.

(51) Int. Cl.
*F41C 23/16* (2006.01)
*F41B 5/14* (2006.01)

(52) U.S. Cl.
CPC ..... *F41C 23/16* (2013.01); *F41B 5/1403* (2013.01)

(58) Field of Classification Search
CPC ..... F42C 23/16; F41B 5/1403
USPC ..... 42/71.01, 94
See application file for complete search history.

(56) References Cited

U.S. PATENT DOCUMENTS

2009/0193702 A1* 8/2009 Lin ..... F41C 23/16 42/72
2015/0204479 A1* 7/2015 Bryant ..... F16M 11/041 348/376
2017/0115090 A1* 4/2017 Bofill ..... F41B 5/123

* cited by examiner

*Primary Examiner* — Bret Hayes
(74) *Attorney, Agent, or Firm* — Christopher J. Vandam, PA; Chris Vandam

(57) ABSTRACT

A weapon foregrip that attaches to a rail on an underside of a weapon. The foregrip has a receiver on a bottom side that mates with a hitch on the top side of a support stick. The joint formed by the receiver and hitch articulate to allow aiming of the weapon. The receiver and hitch are magnetically connected. The foregrip includes removable thumb guards to protect a users hand is the weapon foregrip is used on a crossbow.

4 Claims, 8 Drawing Sheets

WEAPON FOREGRIP

CROSS-REFERENCES TO RELATED APPLICATIONS

The present application is a continuation-in-part of U.S. patent application Ser. No. 14/924,508, filed Oct. 27, 2015, now U.S. Pat. No. 10,209,028, which is hereby incorporated by reference in its entirety.

BACKGROUND OF THE INVENTION

1. Field of the Invention

The present invention relates to weapon accessories, and more particularly, to a foregrip for weapons such as firearms and crossbows.

2. Description of the Related Art

Several designs for weapon foregrip accessories have been designed in the past. None of them, however, includes a foregrip adapted to attach to a forward part of a weapon that includes a ball and hitch to easily attach a shooting stick to the weapon while retaining the ability to articulate relative to the shooting stick and also with removable thumbguards used primarily with some crossbows.

Other patents describing generally related subject matter provide for a number of more or less complicated features that fail to solve the problem in an efficient and economical way. None of these patents suggest the novel features of the present invention.

A brief abstract of the technical disclosure in the specification and title are provided as well for the purposes of complying with 37 CFR 1.72 and are not intended to be used for interpreting or limiting the scope of the claims.

Without limiting the scope of the invention, a brief summary of some of the claimed embodiments of the invention is set forth below. Additional details of the summarized embodiments of the invention and/or additional embodiments of the invention may be found in the detailed description of the invention below.

SUMMARY OF THE INVENTION

It is one of the main objects of the present invention to provide a foregrip that articulably attaches to a shooting stick to stabilize the shooting platform.

It is another object of this invention to provide a foregrip that can be used both on crossbows and firearms.

It is still another object of the present invention to provide a foregrip to shooting stick connection means that allows the weapon to be easily attached and separated from the shooting stick and also provide a range of motion between the shooting stick and weapon to aid the shooter while aiming the weapon.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
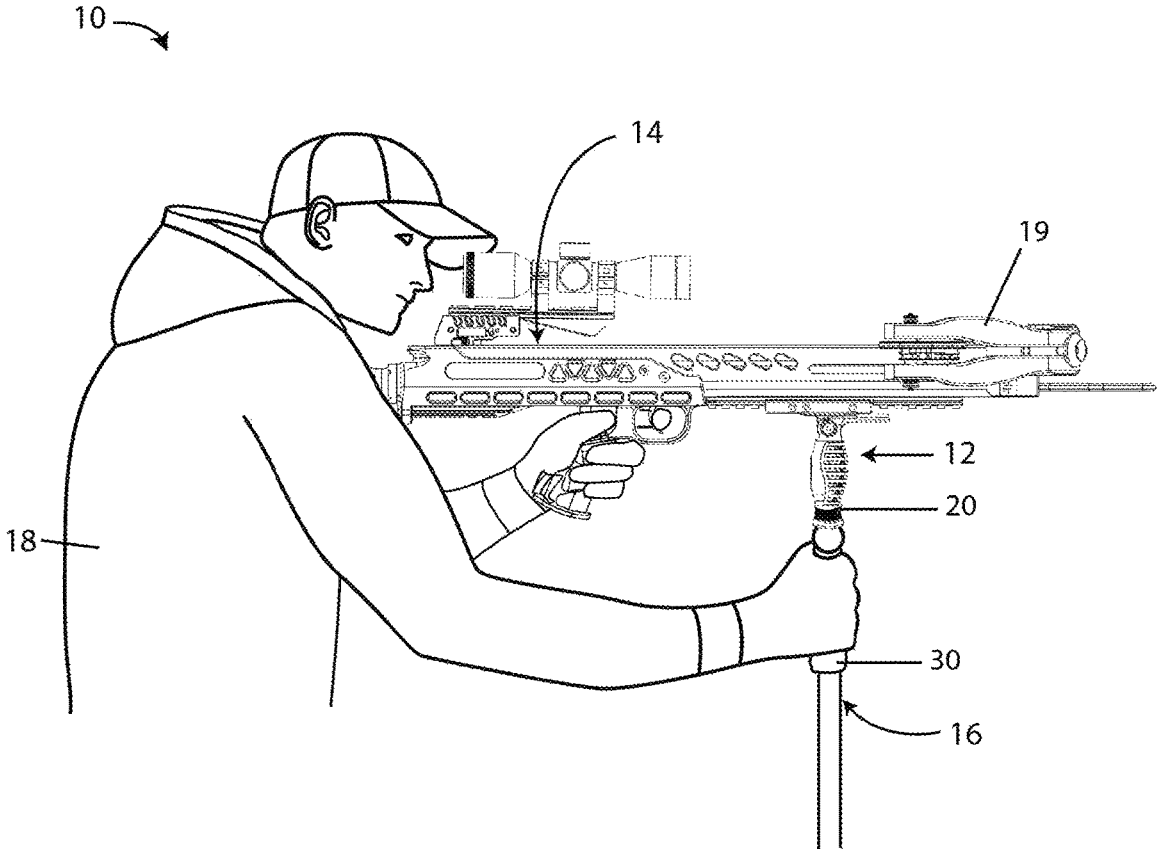
FIG. 1 shows an elevation view of a forearm with a shooting stick attached.

While this invention may be embodied in many different forms, there are described in detail herein specific embodiments of the invention. This description is an exemplary of the principles of the invention and is not intended to limit the invention to the particular embodiments illustrated and described.

For the purpose of this disclosure, like reference numerals in the figures shall refer to like features unless otherwise indicated or is obvious by context.

The subject device and method of use is sometimes referred to as the device, the invention, the weapon foregrip, the foregrip, the forearm, the weapon forearm, the shooting device, the shooting aid, the machine or other similar terms. These terms may be used interchangeably as context requires and from use the intent becomes apparent. The masculine can sometimes refer to the feminine and neuter and vice versa. The plural may include the singular and singular the plural as appropriate from a fair and reasonable interpretation in the situation.

Historically, hunters, shooters, sportsman, law enforcement and other weapon enthusiasts have customized their weapons with aftermarket accessories. The ability to customize their weapons for the anticipated tasks at hand and their personality adds to the utility and enjoyment of their weapons.

However, different weapons have different uses and therefore have different accessories available in the marketplace. For example, hunting weapons may be held in the ready, aiming position for protracted periods while the opportunity to perfect the hunt unfolds and presents itself. In this situation using a shooing support, such as a tripod, bipod or monopod has been useful.

A failing of the prior art is that there is no known mechanism to simply and easily connect the shooting support to the front of the weapon that both allows easy aiming and turning the weapon while also being able to remove the shooting support completely.

One aspect of the present invention allows for the use of the same foregrip accessory with different types of weapons. A crossbow benefits from a thumb guard attached to the foregrip below the travel path of the string. This keeps the thumb of the shooter safe from injury by the string during shooing. However, a weapon platform like a rifle does not have the same risks from hand injury as does the crossbow and therefore does not need any thumb guards.

It is thus an advantage to be able to remove the weight and size of thumb guards when the foregrip is used on a rifle. The removable nature of the thumb guards mean that the same foregrip can be utilized with simply the removal or installation of the thumb guards as appropriate and desired by the user of the weapon.

Referring now to the drawings, where the present invention is generally referred to with numeral 10, it can be observed that it basically includes a foregrip assembly 12, a weapon assembly 14, a monopod assembly 16, a rail 17, an archer 18, limbs 19, a grip 20, a receiver 22, thumbguards 24, a clamp 26, apertures 27, a hinge 28, a grip 30, a hitch 32, an interior 34, a base 36, a weapon assembly 40, a forearm 42, apertures 43, a rail 44, a rail 45, a grip 46, a sight 48, a barrel 50, a hinge 52, a receiver 54, a stock 56, a clamp 58, a receiver 60, a body 62, rails 64, a grip 66, a hinge 68, a hitch 70, a clamp 72, a clamp 74, apertures 76, a surface 78, a surface 80, a joint 82, a grip 84 and a stick 86.

FIG. 1 shows an example of a shooting stance of an archer 18 aiming a weapon assembly 14. In this example, the weapon assembly 14 is a crossbow with limbs 19 on the forward end.

Here, the foregrip assembly 12 is affixed to a rail on the bottom side of the weapon assembly 14 where an archer 18 is likely to support the weight of the weapon assembly 14 when preparing to shoot. There is a grip 20 on the foregrip assembly 12 and an optional grip 30 location on the upper end of the monopod assembly 16. The archer 18 can select which grip 20 or 30 to use.

The monopod assembly 16 is representative of any support structure such as a bipod, tripod or any other support means to aid the user stabilize the weapon assembly 14 to allow the archer 18 to make a more accurate shot by supporting some or all of the forward weight of the weapon assembly 14.

Figure 2:
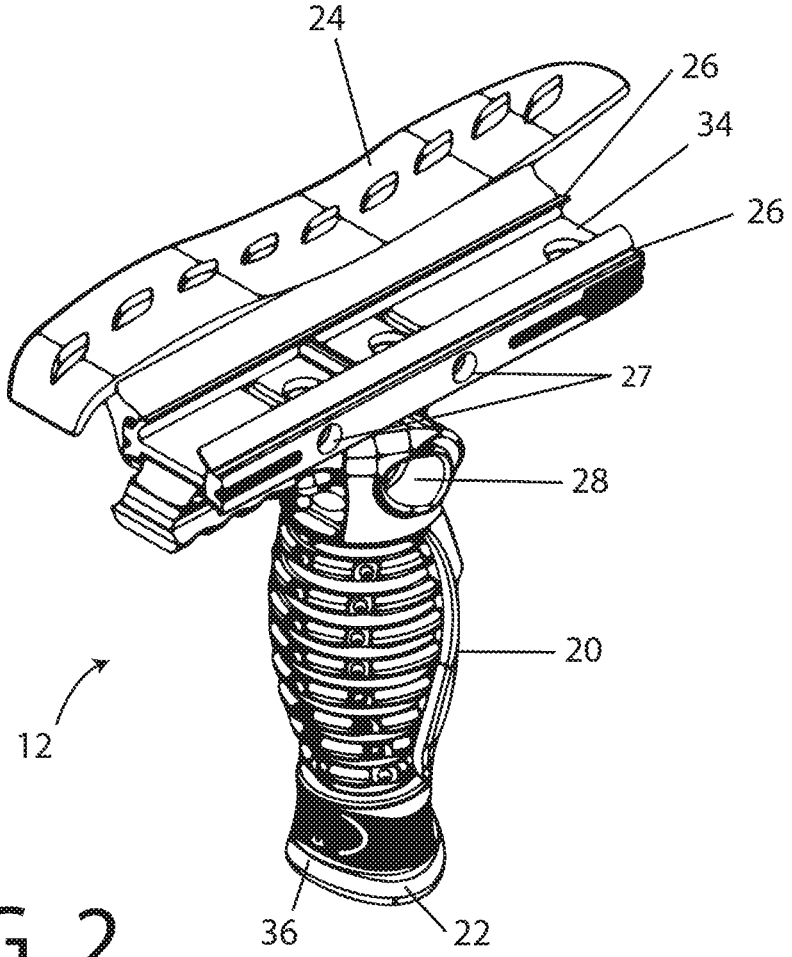
FIG. 2 shows a perspective view of a forearm with a thumb guard removed from one side.
Figure 3:
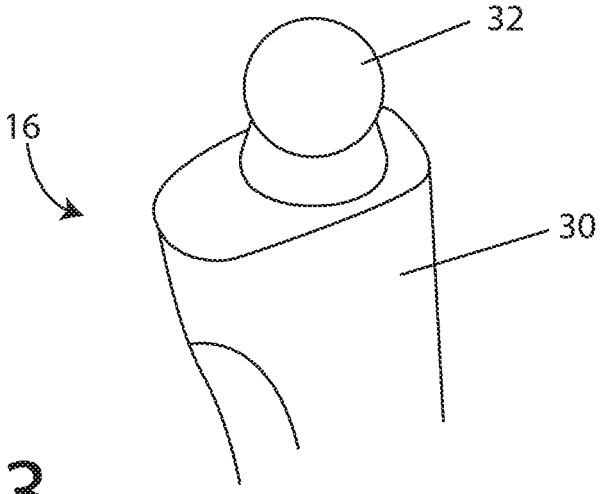
FIG. 3 shows a perspective view of a top section of a shooting stick.
Figure 4:
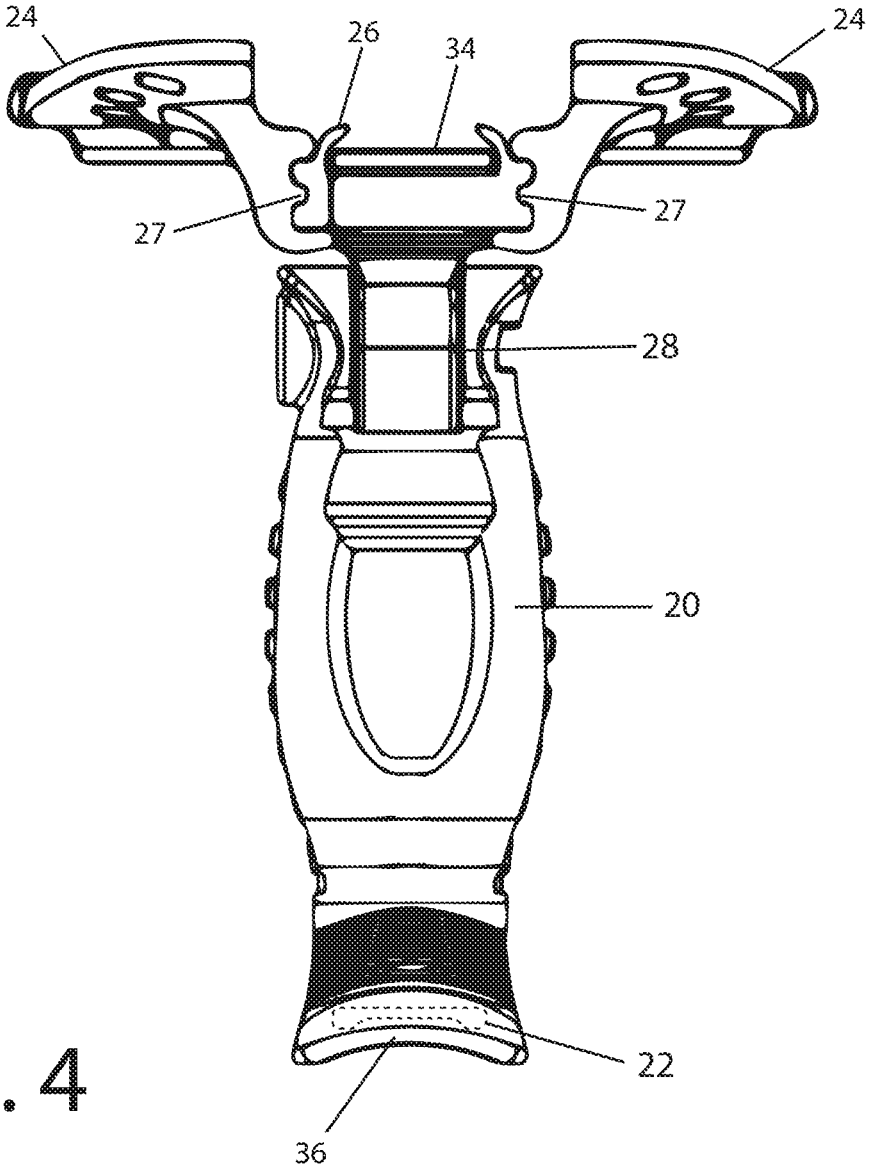
FIG. 4 shows an elevation view of a foregrip with both thumb guards attached.

Looking at the version of the device demonstrated in FIGS. 1-3 in combination, the foregrip assembly 12 attaches to rail 17 near the front of the weapon assembly 14 by placing the interior 34 over the rail 17. The clamps 26 are then tightened to temporarily secure the foregrip assembly 12 to the weapon assembly 14. Because many rails 17 are elongated, the archer 18 can elect to adjust the fore and aft position of the foregrip assembly 12 within a predetermined range.

The foregrip assembly 12 includes apertures 27 into which posts in the edge of the thumb guard 24 may be inserted to connect the thumb guard 24 to the upper side of the foregrip assembly 12. Other connection means to temporarily secure the thumb guard 24 to the foregrip assembly 12 may also be equally employed. For example, pins, screws, clips or other fastening means may also be well suited.

Figure 5:
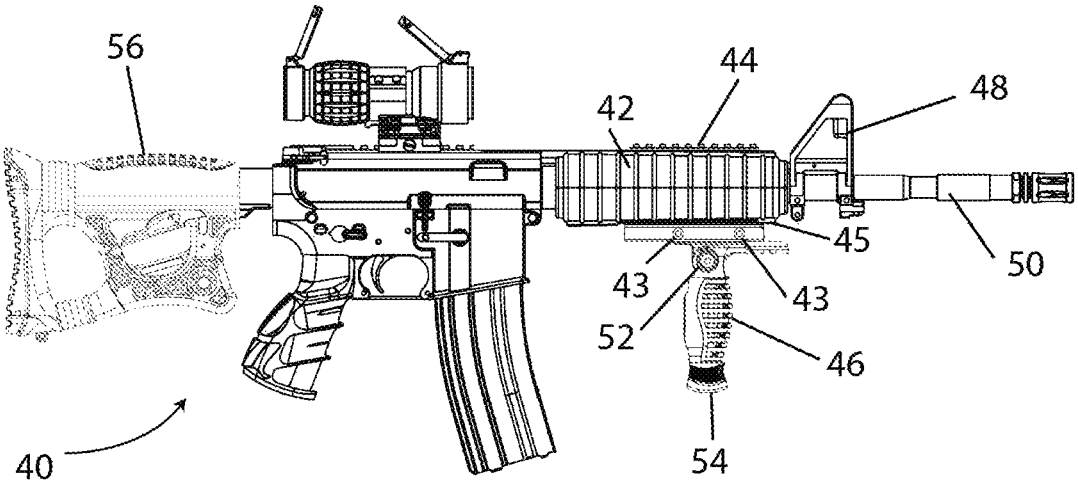
FIG. 5 shows an elevation view of a weapon.

In one version, the upper part of the foregrip assembly 12 is connected to the grip 20 by a hinge 28. The hinge 28 allows the grip 20 to fold along the underside of the barrel. This may be useful while the weapon assembly 14 is being transported or fit into a case, for example. The normal firing or use configuration is generally shown in FIG. 5 on an alternate type of weapon assembly 40. The grip 46 folded in shown generally in FIG. 6 where it is tucked up under the weapon assembly 40, here a firearm.

Looking at FIGS. 1-4, 10 and 11 where a version of the device is shown in it several constituent parts. The upper end of the monopod assembly 16 includes a hitch 32 above the grip 30. The hitch 32 is dimensioned to fit into the receiver 22 in the base 36 of the foregrip assembly 12. As seen in FIG. 3, the hitch 32 is semi-spherical. To complement the hitch 32, the receiver 22 is concave with a similar radius as the hitch 32.

At least one of the hitch 32 and receiver 22 are made of a magnetic material so that the foregrip assembly 12 can be removably affixed to the monopod assembly 16. Because the geometries of the receiver 22 and hitch 32 are complementary and curved they can slide against each other allowing the grip 20 and integral receiver 22 to articulate relative to the monopod assembly 16.

If only one of either the hitch 32 and receiver 22 are magnetic, then the other is magnetically attractable to the magnetic counterpart. For example, a ferrous alloy may be used for the non-magnet hitch 32 or receiver 22. It is a key feature in at least one version of the invention that the lower end of the foregrip assembly 12 be temporarily connectable to the upper end of the monopod assembly 16 and that this connection is readily articulable to allow the weapon assembly 14 to be adjusted during the target acquisition or aiming process.

The strength of the magnetic attraction between the receiver 22 and the hitch 32 should also be adapted so that the foregrip assembly 12 remains articulably attached to the monopod assembly 16 sufficiently that the archer 18 can raise and move the weapon assembly 14 by grabbing the grip 20 affixed to the weapon assembly 14 without holding the monopod assembly 16 and also lift and move the monopod assembly 16.

However, in some scenarios, the magnetic strength should be weak enough that if the archer wishes to separate the foregrip assembly 12 from the monopod assembly 16 a brisk tug on the grip 30 of the monopod assembly 16 will snap the pieces apart. For example, this could be useful when tracking game through the bush and the monopod 16 becomes a liability rather than a shooting stabilizing asset.

Alternatives to the above described shapes of the receiver 22 and corresponding hitch 32 may also be suitably employed when performance characteristics similar to those described supra are followed. For example, certain gimbals, clip assemblies, ball and claws or other articulable and separable junctions may be successful and fall within the specific scope of the foregrip device.

As noted above a weapon assembly such as that seen in FIG. 1 is operated by an archer 18, the other considered weapon assemblies shown in the other figures, for example FIGS. 5-9, could also be described as a shooter. The terms archer and shooter may be use interchangeably and only refer to the type of weapon assembly and does not necessarily reflect the features, components or usage of the device and integrated weapon assemblies.

Looking at FIGS. 5, 6, 10 and 11 where an alternate usage of the foregrip assembly is demonstrated on an alternate type of weapon assembly 40. It is an important aspect of the invention is that it is adapted to be used effectively on both stringed weapons and firearms. No longer does a sportsman need to purchase different accessories for different hunting weapons.

Importantly, the thumb guards 24 that are seen in the drawings with the crossbow 14 are absent and not connected to the exterior surface of the clamp on the upper sides of the grip 46. The apertures 43 are present so that the thumb guards 24 could be re-attached if desired. However, for the type of weapon assembly 40 in FIGS. 5-9 there is no need to protect the operator's fingers because there is no string on a firearm to endanger the fingers of the user.

Figure 6:
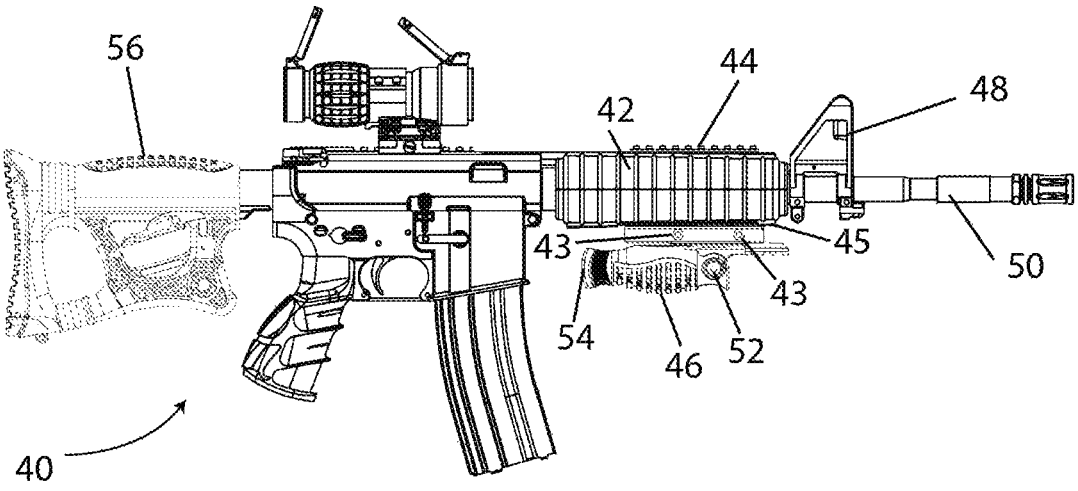
FIG. 6 shows an elevation view of a weapon.

The version of the device as seen in FIGS. 5 and 6 is temporarily affixed to a rail 45 on the underside of the weapon assembly 40. The rail 45 is present as stock equipment on many weapons, including both firearms and crossbows. The rail 45 can be used to affix a variety of accessories to the weapon such as flashlights. In at least one example, the rail 45 is similar in format to rails commonly known in the art as a weaver or picatinny rail system for universal mounts.

It should be noted that grip 46 may be folded about hinge 52, as seen in FIG. 6. This mode may be beneficial for transport or any other time when the monopod support may not be wanted by a user of the weapon assembly 40. When folded the grip 46 is moved out of the way but still may be used, for example, to support the weapon with the hand of the operator of the weapon.

The grip 46 may also lowered as seen in FIG. 5 to expose the receiver 54 towards the bottom side of the weapon assembly 40. In this mode the receiver 54 is positioned to accept the hitch 32 on the top of a monopod assembly 16. The receiver 54 is adapted to fit into a hitch 32 so that they mate together under magnetic force and are also able to articulate relative to each other so that the weapon assembly 40 may be more easily aimed when supported by the monopod assembly 16.

Either or both the receiver 54 on the grip 46 and the hitch 32 on the monopod assembly may be magnetic. The mating part may also be magnetic or may also merely be attracted by the magnetic properties of the corresponding respective receiver 54 or hitch 32. The magnetic attraction force should be strong enough to allow the operator to pick up the weapon assembly 40 without actually touching the monopod assembly 16 directly and the monopod assembly 40 will stay attached to the receiver 54. In essence the monopod assembly 16 can dangle from the receiver 54 without further coupling to the weapon assembly 40.

The force of the magnetic attraction between the receiver 54 and hitch 32 should also be weak enough so that the operator can tug the monopod assembly 16 and separate it from the rest of the weapon assembly 40 as might be needed for transport or other purposes needed by the operator of the weapon.

Figure 7:
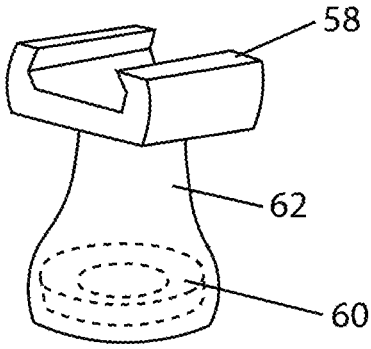
FIG. 7 shows a perspective view of version of a receiver assembly isolated from a weapon.
Figure 8:
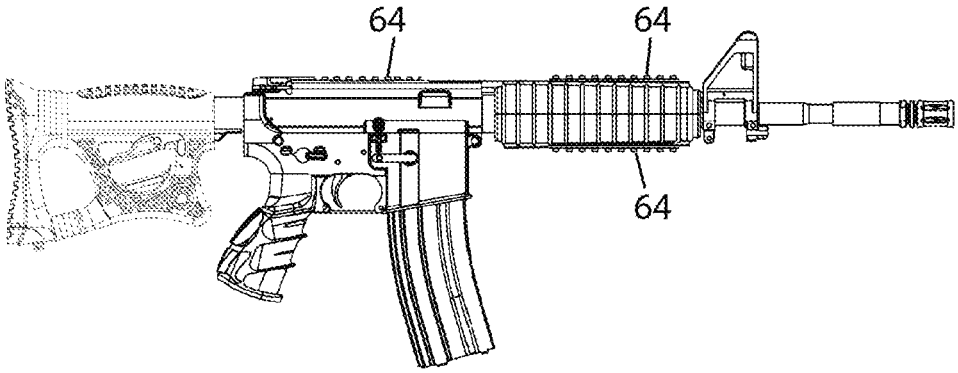
FIG. 8 shows an elevation view of a firearm.
Figure 9:
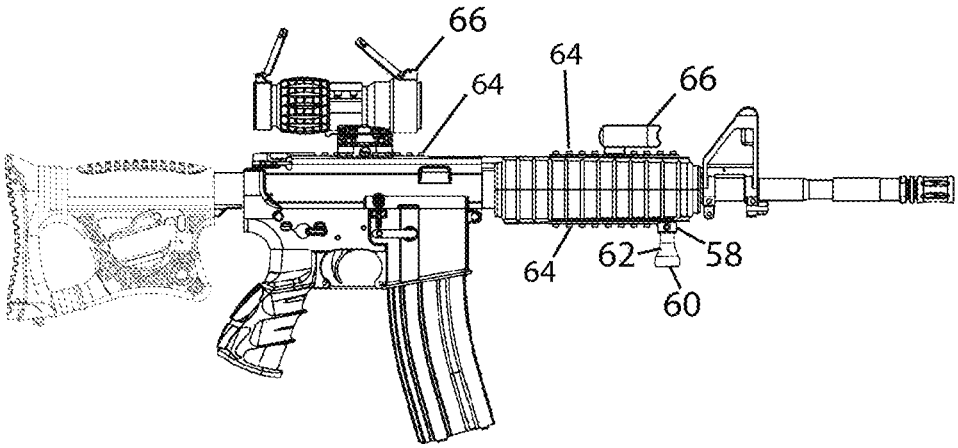
FIG. 9 shows an elevation view of a firearm.
Figure 10:
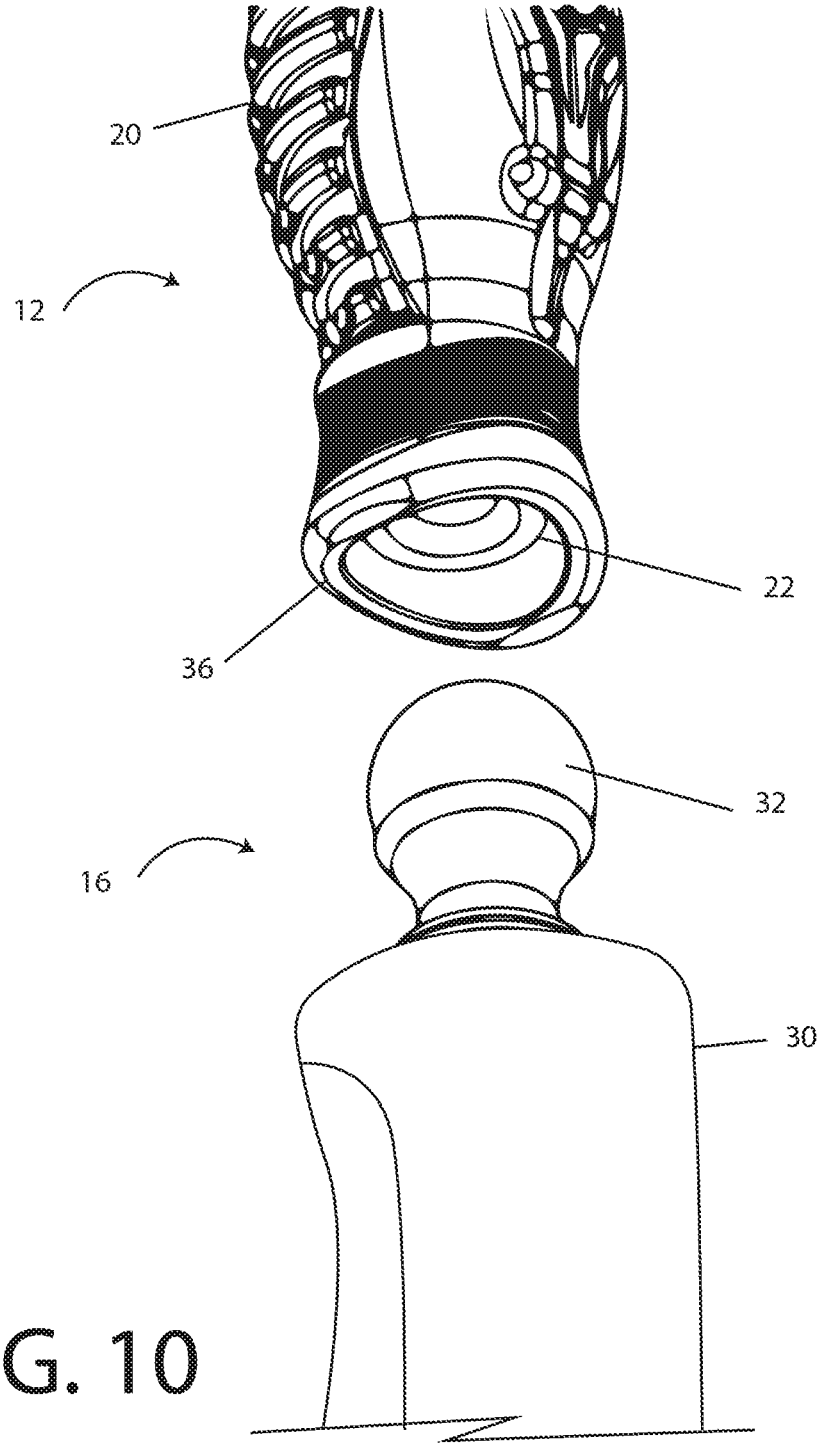
FIG. 10 shows a perspective close up view of a partial foregrip assembly and partial monopod assembly.
Figure 11:
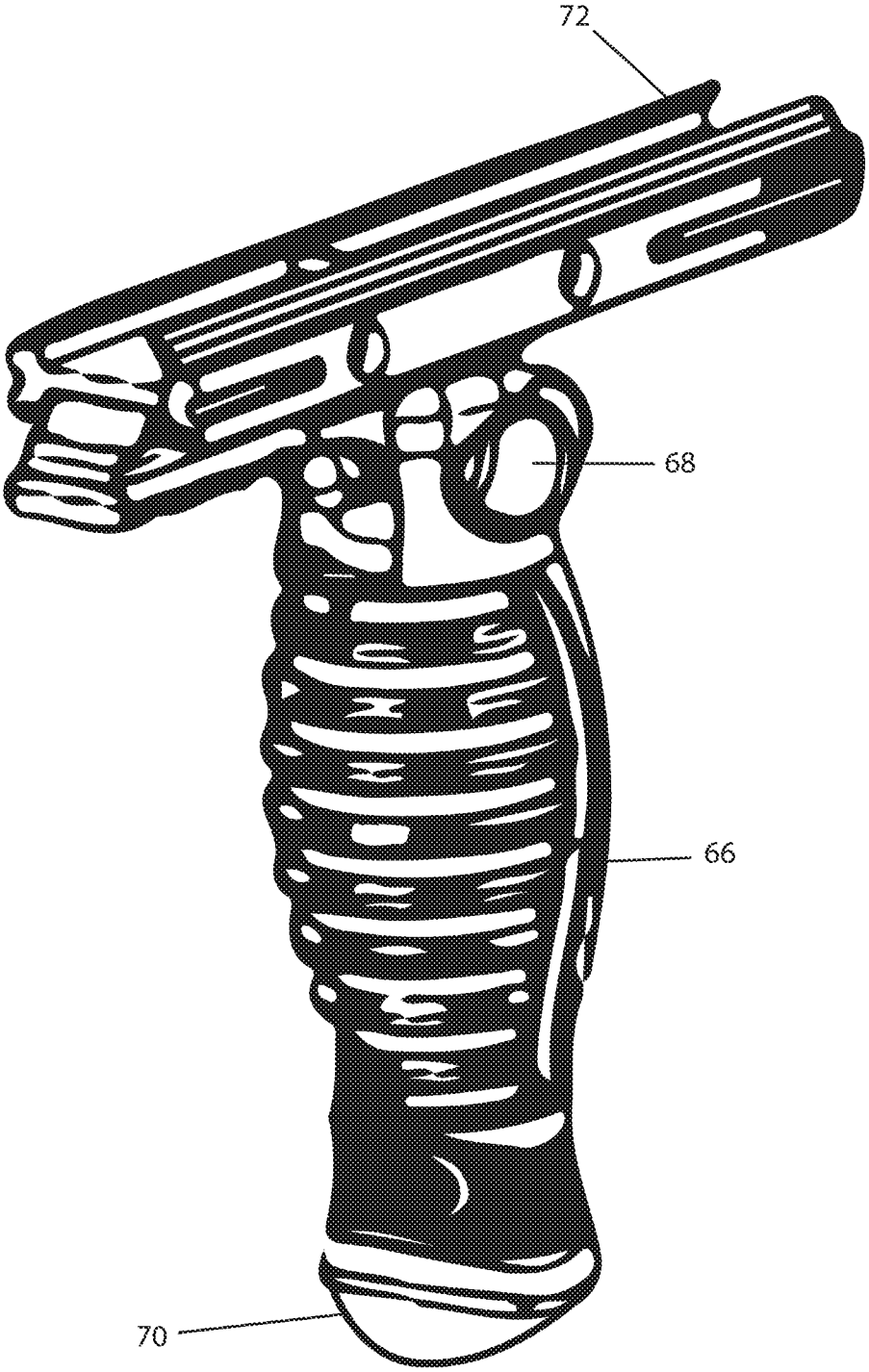
FIG. 11 shows a perspective view of a foregrip assembly.

FIGS. 7-9 demonstrate an alternate embodiment of the present invention that utilizes the inventive concept. FIG. 7 shows an isolated fixture comprised of a clamp 58, a receiver 60 and a body 62. The clamp 58 affixes to a rail 64 on the lower side of the weapon. In this orientation the receiver 60 is also exposed downward. Other accessories 66 for the weapon are attached to other rails 64.

Similar to the other versions, the receiver 60 is adapted dimensionally to engage with a monopod assembly magnetically while retaining the ability to articulate about the receiver 60 and hitch 32 joint. This lower profile body 62 may or may not be used also as a handle, depending on the overall dimensions of the body 62.

Figure 12:
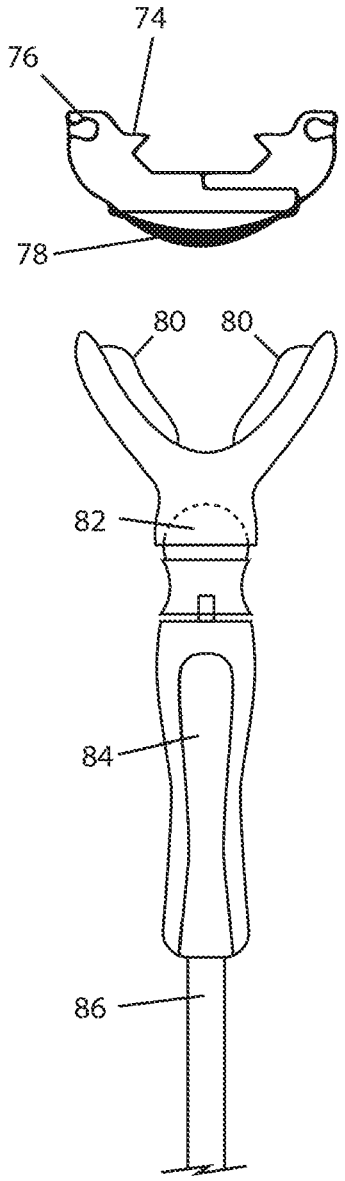
FIG. 12 shows an elevation view of a foregrip and support stick assembly.

FIG. 12 demonstrates another variation of the inventive concepts including a clamp 74, an aperture 76, a surface 78, surfaces 80, a joint 82, a grip 84 and a stick 86. The clamp 74 attaches to a rail on a firearm or a crossbow. The apertures 76 on each the right and left side of the clamp 74 are available to attach to a thumb guard if used on a crossbow to protect the users fingers from the crossbow string.

The shooting stick 86 is provided that is similar to the monopod and its variations as discussed above. The upper end of the shooting stick 86 includes a pair of complementary surfaces 80 that cradle the surface 78 that is attached to the weapon. The surfaces 80 and or surface 78 may be magnetic or magnetically attractable so that the surfaces 80 magnetically stick to the surface 78.

The union between made when surfaces 80 connect magnetically to surface 78 is articulable to allow the user to aim the attached weapon in any degree or orientation. The magnetic attraction should be sufficient to allow the user to lift the stick 86 without further support yet be weak enough that the user can separate the surface 78 from the surfaces 80 for transport or other uses.

The stick 86 includes a grip on an upper end adapted and dimensioned to a predetermined human hand. The grip 84 allows the user to control the stick 86 better and therefore the weapon attached to the clamp 74 will be more controllable.

A joint 82 is optionally present at the upper end of the stick 86 to provide for an additional dimension of movement. The joint 82 may be articulable about elements similar to the hitch and receiver in other versions of the design. The joint 82 may also be magnetic so that it is operationally separable by the user in the field by hand and without the use of tools.

An important version of the invention can be fairly described as a weapon foregrip comprised of, inter alia, a foregrip assembly and a support stick. The foregrip assembly is comprised of a grip having a clamp on an upper end and a receiver on a lower end. The clamp is affixed to a rail integral to an underside of a preselected weapon. A first joint is between and connects the clamp to the grip. The first joint optionally articulates the grip between a first position substantially perpendicular to a barrel of the weapon in an action mode and a second position substantially parallel to the barrel when the grip is not being used to hold the weapon. The support stick has on an upper end a hitch. The hitch is magnetically attracted to the receiver. The hitch is dimensionally adapted to fit against the receiver forming an articulating second joint between the support stick and the grip. The clamp has a removable thumb guard along a left edge parallel to the barrel and a removable thumb guard along a right edge parallel to the barrel. The thumb guard prevents a thumb from a path of a string if the weapon is a crossbow. The support stick may be any of a monopod, bipod, tripod, bag rest or other device to support the weapon.

Another version of the inventive concept can be fairly described as a weapon support device comprised of a receiver assembly and a support assembly. The receiver assembly has a clamp on an upper end and receiver on a lower end. The clamp attaches to a rail on an underside of a preselected weapon, for example a long gun or a crossbow. The support assembly has a hitch on an upper end. The receiver is dimensioned to fit is against the hitch forming an articulating joint. The hitch is magnetically attracted to the receiver with sufficient magnetic strength that the support assembly can be lifted by the articulating joint alone. The support stick may be any of a monopod, bipod, tripod, bag rest or other device to support the weapon.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A weapon foregrip comprised of a foregrip assembly and a support stick;

the foregrip assembly is comprised of a hand grip between a clamp on an upper end and a magnetic receiver on a lower end;

the clamp is affixed to a rail integral to an underside of a preselected weapon;

a first joint is between and connects the clamp to the grip;

the first joint articulates the foregrip assembly between a first position substantially perpendicular to a barrel of the weapon and a second position substantially parallel to the barrel;

the support stick has on an upper end a magnetic hitch;

the magnetic hitch is magnetically attracted to the magnetic receiver;

the magnetic hitch is dimensionally adapted to fit against the magnetic receiver forming an articulating second joint;

the clamp has a removable thumb guard along a left edge parallel to the barrel and a removable thumb guard along a right edge parallel to the barrel;

each thumb guard preventing a thumb from entering a path of a string if the weapon is a crossbow.

2. The weapon foregrip in claim 1 further characterized in that the support stick is any of a monopod, bipod or tripod.

3. A weapon support device comprised of a receiver assembly and a support assembly;

the receiver assembly has a clamp on an upper end and a magnetic receiver on a lower end;

the clamp attaches to a rail on an underside of a preselected weapon;

the support assembly has a magnetic hitch on an upper end;

the magnetic hitch is semi-spherical;

the magnetic receiver is curved complementary to the magnetic hitch and dimensioned to fit against the magnetic hitch forming an articulating joint;

the magnetic receiver magnetically connects to the magnetic hitch and lifts an entire weight of the support assembly.

4. The weapon support device in claim 3 further characterized in that the support assembly comprises any of a monopod, a bipod or a tripod.

* * * * *